US007121418B2

(12) United States Patent
Stier

(10) Patent No.: US 7,121,418 B2
(45) Date of Patent: Oct. 17, 2006

(54) STORE FIXTURE WITH SWING ARMS

(76) Inventor: Randal J. Stier, 312 Gildner Rd., Central Square, NY (US) 13036

( * ) Notice: Subject to any disclaimer, the term of this patent is extended or adjusted under 35 U.S.C. 154(b) by 178 days.

(21) Appl. No.: 10/867,242

(22) Filed: Jun. 14, 2004

(65) Prior Publication Data

US 2005/0274685 A1 Dec. 15, 2005

(51) Int. Cl.
*A47B 43/00* (2006.01)

(52) U.S. Cl. ..... 211/206; 211/206; 211/204; 211/208; 211/163; 403/348

(58) Field of Classification Search ..... 211/206, 211/7, 16, 133.1, 49.1, 59.4, 163, 105.1, 124, 211/94.01, 95, 115, 168, 123, 204, 105; D6/315; 403/348, 349; 285/276
See application file for complete search history.

(56) References Cited

U.S. PATENT DOCUMENTS

| | | | | | |
|---|---|---|---|---|---|
| 340,753 | A | * | 4/1886 | Bardsley | 211/123 |
| 850,363 | A | | 4/1907 | Frankel | |
| 1,015,448 | A | * | 1/1912 | Madden | 211/182 |
| 2,095,384 | A | * | 10/1937 | Gleitsman | 217/125 |
| 2,451,110 | A | | 10/1948 | Newman | 211/94 |
| 2,650,717 | A | | 9/1953 | Larson | 211/178 |
| 2,706,563 | A | | 2/1955 | Larson | 211/178 |
| 2,947,422 | A | * | 8/1960 | Sudbery | 211/47 |
| 3,267,593 | A | * | 8/1966 | Turner | 36/59 R |
| 3,635,352 | A | * | 1/1972 | Brooks et sl. | 211/47 |
| 3,692,188 | A | | 9/1972 | Bayne | 211/49 D |
| 3,993,195 | A | * | 11/1976 | Caligiuri | 211/7 |
| 4,316,547 | A | | 2/1982 | Varon | 211/105.1 |
| 4,655,354 | A | | 4/1987 | Cohen | 211/199 |
| 4,811,853 | A | * | 3/1989 | Mead et al. | 211/124 |
| 4,981,227 | A | | 1/1991 | Ingram | 211/204 |
| 5,191,984 | A | * | 3/1993 | Kon et al. | 211/115 |
| 6,108,944 | A | * | 8/2000 | Savoie | 36/134 |
| 6,390,311 | B1 | * | 5/2002 | Belokin | 211/204 |
| 6,607,086 | B1 | * | 8/2003 | Gretz | 211/123 |
| 2005/0109721 | A1 | * | 5/2005 | Scheider et al. | 211/118 |

* cited by examiner

*Primary Examiner*—Richard E. Chilcot, Jr.
*Assistant Examiner*—Lindsay M. Maguire
(74) *Attorney, Agent, or Firm*—Bernhard P. Molldrem, Jr.

(57) ABSTRACT

A store fixture for displaying apparel or other hangable merchandise employs a horizontal support bar that is supported at an elevated position, and at least one swing-arm hang bar is pivotally supported situated underneath the horizontal support bar. The swing-arm hang bar has one or more projecting rods or tubes serving as arms on which the hangable merchandise can be suspended. The swing arm has a sleeve journaled on a pivot that is affixed to the support arm. There is a detent arrangement provided between the pivot and the sleeve, so that the swing-arm hang bar releasably locks into a first position that is at one angle to the horizontal support bar, parallel to the support bar, and a second position that is at another angle, a right angle, to it. Store personnel can change the orientation of the hang bars by simply lifting them up slightly to release the detents and ten rotating them to the desired position. Re-arranging the hang bars does not require any tools, nor removal or installation of any parts.

9 Claims, 1 Drawing Sheet

STORE FIXTURE WITH SWING ARMS

BACKGROUND OF THE INVENTION

This invention is directed to store fixtures or racks of the type used for displaying merchandise, and is more particularly concerned with store fixtures that can be used for displaying hanging articles, e.g., shirts, jackets, or other articles of apparel. The invention is more particularly concerned with a display rack in which can be easily reconfigured in the store without tools between an in-line orientation and a transverse orientation.

Retailing of apparel and other similar items to customers requires that the articles be displayed in a way that will be attractive to the purchaser, and which will allow store personnel to display the clothing articles in an optimal way. Typical display racks have a hang bar that is supported on a standard or between standards above the floor, or else have a hang bar that is cantilevered from a wall or other support, with the clothing articles being hung from the hang bar.

It is desirable that the store fixtures be a simple a design as possible, so that the store personnel can set them up and reconfigure them without having to use tools and without having to remove or add any parts. A number of foldable or reconfigurable display racks have been presented, and some of these appear in U.S. Pat. No. 4,655,354 to Cohen; U.S. Pat. No. 4,981,227 to Ingram; and U.S. Pat. No. 4,316,547 to Varon. The Varon display rack is of interest in that it employs a main transverse hang rail and additional transverse hang rails that are cantilevered at right angles onto the main rail. Varon has U-shaped brackets for the transverse hang rails, so that the transverse hang rails can only be positioned at a right angle to the main rail.

What is not currently available is a store display rack that can be easily set up and reconfigured from an in-line display orientation for clothing to a transverse orientation, and in which the rack can be easily reconfigured, in only a few seconds, without need for tools or additional parts.

OBJECTS AND SUMMARY OF THE INVENTION

Accordingly, it is an object to provide a store fixture or display rack of an improved design that is simple to use and can be easily and quickly reconfigured between an in-line orientation and a transverse orientation.

It is another object to provide a store fixture that has swing arm hang bars that can be rotated by hand between positions, and which remain securely in their positions.

According to an aspect of this invention, a store fixture assembly is provided for the display of hangable merchandise. A main horizontal support bar is supported in an elevated position, e.g., by means of vertical standards. There can be one or more than one swing-arm hang bar situated underneath the horizontal support bar and on which the hangable merchandise can be suspended. Favorably, these are double ended, with bars or rods extending oppositely from a tubular pivot sleeve. A pivot arrangement projects vertically downward from the underside of the horizontal support bar, and supports the swing-arm hang bar. This includes a releasable detent arrangement for releasably locking the hang bar into a first position that is parallel to the horizontal support bar and a second position that is substantially at a right angle to the horizontal support bar. The pivot mechanism can employ a vertical pivot pin that penetrates through the tubular sleeve, in which case the detent mechanism can employ posts or other key members that project out radially from the lower end of the pivot pin and engage notches or cutouts in the lower end of the tubular sleeve. The key members hold the swing arm hang bar up, and also lock it releasably in place in either of its two positions, parallel to the upper main support bar or at right angles to the support bar.

In one preferred embodiment, there are two swing-arm hang bars supported at spaced positions along the underside of the main rail. The hang bars and main support bar can be extruded tubes or round profile, or alternatively may be square in cross section.

The above and many other objects, features, and advantages of this invention will become apparent from the ensuing description of a selected preferred embodiment, which is to be considered in connection with the accompanying Drawing.

DETAILED DESCRIPTION OF THE PREFERRED EMBODIMENT

Figure 1:
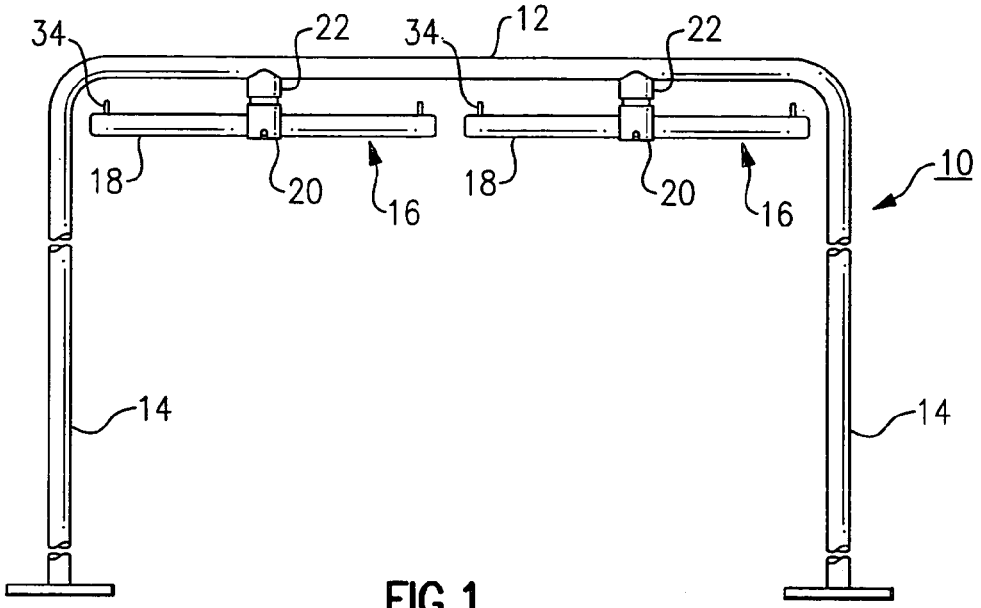
FIG. 1 is a partial perspective view of a swing-arm store fixture for displaying clothing articles, according to one preferred embodiment of this invention.

With reference to the Drawing, FIG. 1 thereof illustrates store fixture 10 according to one embodiment of this invention. In this embodiment, the fixture 10 is a clothes rack assembly, upon which various items of wearing apparel can be displayed by hanging them on the fixture. This embodiment is especially suited for display of sportswear, but other items could be displayed, e.g., coats, jackets, blouses, dresses, trousers, or the like. The fixture 10 has an upper horizontal support bar 12, which here is supported at its ends on vertical posts or standards 14. These maintain an appropriate height above the floor or other surface for display of the articles. Here, the support bar 12 has curved ends, i.e., 90-degree bends, that meet the vertical supports or standards 14, but other embodiments can have different configurations. It is also possible, for example, that the support bar be cantilevered from a wall mounting or from a cabinet, or that the bar 12 be suspended from the ceiling.

Figure 2:
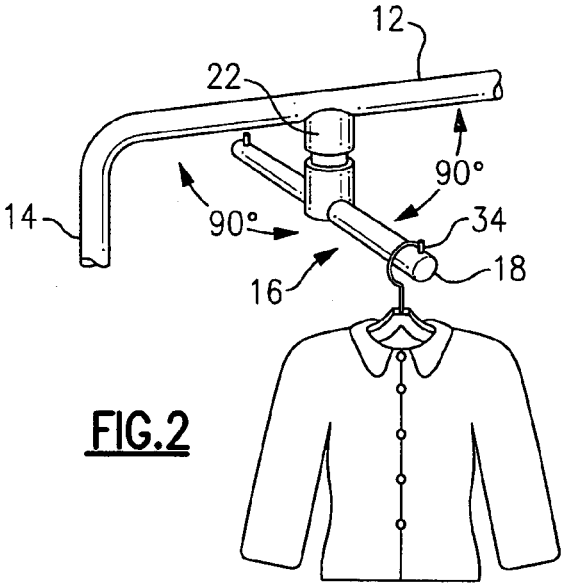
FIG. 2 is a partial perspective view of this embodiment, showing the swing-arm hang bar rotated to its transverse position.

A pair of swing-arm racks or hang bar members 16 are pivotally supported from the under side of the support bar 12, and these hang bar members 16 are capable of being oriented into either of a parallel position (FIG. 1) in which the hang bar members are parallel to the support bar, or a transverse position (FIG. 2) in which the hang bar members are at a right angle to the support bar. Of course, the two hang bar members 16 are independent, and if desired one of the hang bar members 16 can be in one position and the other hang bar member can be oriented in the other position.

In this embodiment, there are two swing-arm hang bar members 16, but in other embodiments there may be only a single swing-arm member, or there may be three or more.

Each of the swing-arm hang bar members 16 is formed of a pair of horizontal tubes or rods 18 that are affixed onto opposite sides of a tubular pivot sleeve 20. Each such pivot sleeve is supported on a pivot pin arrangement 22 that is affixed onto the support bar 12. Here, the pivot pin arrangements are welded onto the under side of the support bar. A detent mechanism on the pivot pin arrangement, explained just below, holds the swing-arm hang bar member releasably in each of its parallel and transverse positions.

Figure 3:
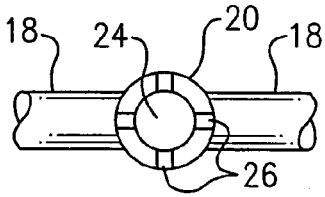
FIG. 3 is bottom view of the pivot sleeve portion of the swing-arm hang bar of this embodiment.
Figure 4:
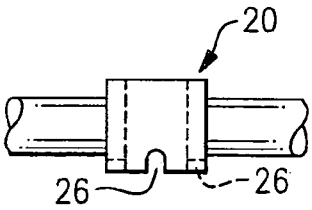
FIG. 4 is a partial sectional elevation of pivot sleeve portion of the swing-arm hang bar of this embodiment.

As shown in FIGS. 3 and 4, the sleeve 20 has its two respective rods 18 welded to it at angular intervals of 180 degrees. In this embodiment, the rods 18 extend horizontally, but in other embodiments, at least some of the rods could extend sloping downwardly. The sleeve has a cylindrical internal void 24, and cutouts or grooves 26 extending radially at the lower end of the sleeve 20 at 90 degree intervals. These cutouts or grooves serve as detents.

Figure 5:
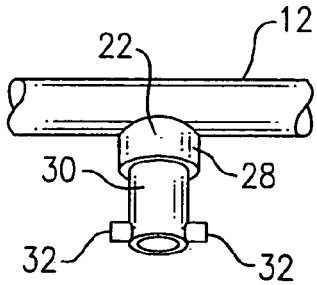
FIG. 5 is a perspective view of the pivot pin and a portion of the upper support bar of this embodiment.

As shown in FIG. 5, the pivot pin arrangements 22 are each formed of an upper tubular nipple 28 of substantially the same outside diameter as the sleeve 20, and below that a cylindrical pivot pin 30 that has a diameter closely matching the cylindrical internal void 24 of the sleeve 20. A pair of pegs or pins 32 are affixed onto the lower end of the pivot pin 30 and extend radially from opposite sides. These pins 32 support the sleeve 20 vertically, and lodge in an opposed pair of the cutouts 26 to serve as key members so that they releasably lock the swing-arm hang bar 16 in the selected one of its parallel and transverse positions.

There may be pegs 34 or other blocking members at the radial outward ends of the rods 18 to assist in keeping clothes hangers on the clothes rack. Other means can be used instead for this function without departing from the main principles of this invention.

The store fixture can be easily configured or reconfigured, without the need for any special tools or without having to remove and replace any parts. If, for example, the fixture 10 has its swing-arm hang bar members 16 both oriented in the parallel position as shown in FIG. 1, store personnel can simply lift one or the other of the hang bar member 16 slightly so that the grooves 26 are disengaged from the key members or pins 32. Then he or she simply rotates the swing-arm member 16 ninety degrees to the transverse position, and it will lock in that position as the pins 32 engage the other pair of grooves 26. Then, the store personnel can hang clothing upon the rod or rods 18. Reconfiguration of the store fixture takes only a few seconds to accomplish, and can be done at very low inconvenience to store personnel or to customers whenever it is desired to optimize the display of merchandise.

In this embodiment, the swing-arm display members 16 each have two display tubes or rods 18 of equal size and situated directly opposite to one another on the sleeve 20. In other possible embodiments, the rods 18 may be of unequal size, or there may be a different number on the swing-arm assembly 16. For example, some swing-arm hang bars may have only a single rod 18, and others may have three or four rods. In some possible embodiments, in may be possible to orient the swing-arm hang bars at positions other than parallel or perpendicular to the support bar.

Also, many other detent mechanisms or releasable locking means for the swing-arm hang bar are known and available, besides what is shown here.

It should be understood that the illustrated embodiment is intended for displaying sportswear or similar wearing apparel, but is representative of store fixtures or display racks for any of a wide variety of hangable merchandise. Moreover, while the invention has been described hereinabove with reference to a selected preferred embodiment, it should be recognized that the invention is not limited to that embodiment. Rather, many modification and variations would present themselves to persons skilled in the art without departing from the scope and spirit of this invention, as defined in the appended claims.

I claim:

1. A store fixture assembly for the display of hangable merchandise, comprising:

a horizontal support bar;

means supporting the horizontal support bar at an elevated position;

at least one swing-arm hang bar situated underneath said horizontal support bar and on which the hangable merchandise can be suspended;

at least one pivot pin portion affixed onto an under side of said horizontal support bar and at least one rotatable sleeve on which a respective one of said at least one hanger bar is affixed, and which is journalled on said pivot pin portion such that said swing-arm hang bar is rotatable about its respective pivot pin;

wherein said pivot pin portion includes an upper cylindrical member of a first diameter, and a pivot pin member extending downward therefrom, and said rotatable sleeve is a cylindrical tubular member, at least one key member that projects radially outward from a lower end of said pivot pin member, and a plurality of notches at a lower end of said rotatable sleeve, such that the key members support the swing arm hang bar and also lock the same releasably in place at either of first and second positions, one of which, is at a different angle relative to said support bar; and wherein there is a limited vertical play as between said pivot pin member and said rotatable sleeve, limited in its upward travel by said upper cylindrical member; such that the swing-arm hang bar can be released from its first and second positions by moving the rotatable sleeve upward.

2. A store fixture assembly according to claim 1 wherein said means notches are spaced at 90 degree intervals for releasably engaging said key and locking said at least one hang bar into said first position that is parallel to said horizontal support bar and into said second position that is substantially at a right angle to said horizontal support bar.

3. A store fixture according to claim 1 wherein said horizontal support bar has first and second arcuate ends integrally formed thereon which join to respective vertical support posts.

4. A store fixture according to claim 1 wherein each said at least one swing-arm hang bar has first and second rod members each projecting radially from opposite sides of its respective rotatable sleeve.

5. A store fixture according to claim 4 wherein there are two said swing-arm hanger bars each rotationally supported on a respective one of first and second pivot pins, said pivot pins being affixed at spaced locations along said horizontal support bar.

6. A store fixture according to claim 1 wherein said pivot pin comprises a pair of transverse key members that protrude radially from opposite sides at a lower end of said at least one pivot pin, and said rotatable sleeve has a plurality of recesses formed in a lower end thereof which engage said pins when the hanger bar is in its first position and in its second position.

7. A store fixture according to claim 1 wherein said horizontal support bar is formed of a tubular extrusion and said at least one swing-arm hang bar is formed of a tubular extrusion.

8. A store fixture according to claim 1 wherein said rotatable sleeve is a cylindrical tubular member having an outer diameter substantially the same as said first diameter.

9. A store fixture according to claim 1 wherein said swing arm hang bar has an upwardly directed post positioned at a distal end thereof.

* * * * *

UNITED STATES PATENT AND TRADEMARK OFFICE

CERTIFICATE OF CORRECTION

PATENT NO. : 7,121,418 B2
APPLICATION NO. : 10/867242
DATED : October 17, 2006
INVENTOR(S) : Randal J. Stier It is certified that error appears in the above-identified patent and that said Letters Patent is hereby corrected as shown below:

Abstract, line 16: "ten" should read --then--

Col. 4, Claim 2, line 30: "means" should be deleted.

Signed and Sealed this

Ninth Day of January, 2007

JON W. DUDAS
*Director of the United States Patent and Trademark Office*